US006997575B2

(12) United States Patent
Sommers

(10) Patent No.: US 6,997,575 B2
(45) Date of Patent: Feb. 14, 2006

(54) APPARATUS AND MANUFACTURING METHOD FOR BORDER LIGHTING

(75) Inventor: Mathew Sommers, Sagamore Hills, OH (US)

(73) Assignee: GELcore LLC, Valley View, OH (US)

( * ) Notice: Subject to any disclaimer, the term of this patent is extended or adjusted under 35 U.S.C. 154(b) by 252 days.

(21) Appl. No.: 09/683,635

(22) Filed: Jan. 29, 2002

(65) Prior Publication Data

US 2003/0142492 A1 Jul. 31, 2003

(51) Int. Cl.
*F21S 4/00* (2006.01)

(52) U.S. Cl. ..... 362/219; 362/235; 362/249; 362/800

(58) Field of Classification Search ..... 362/249, 362/235–237, 219, 800, 545, 555, 244, 221–224, 362/377–378, 391, 396, 429, 240, 248
See application file for complete search history.

(56) References Cited

U.S. PATENT DOCUMENTS

| | | | | |
|---|---|---|---|---|
| 4,950,958 | A * | 8/1990 | Lin | 315/185 R |
| 5,032,960 | A * | 7/1991 | Katoh | 362/240 |
| 5,136,483 | A | 8/1992 | Schöniger et al. | |
| 5,155,669 | A | 10/1992 | Yamuro | |
| 5,337,225 | A * | 8/1994 | Brookman | 362/145 |
| 5,672,000 | A * | 9/1997 | Lin | 362/249 |
| 5,815,068 | A * | 9/1998 | Vadseth | 340/332 |
| 5,848,837 | A | 12/1998 | Gustafson | |
| 6,074,074 | A * | 6/2000 | Marcus | 362/240 |
| 6,559,879 | B1 * | 5/2003 | Kobayashi et al. | 347/238 |
| 6,659,622 | B1 * | 12/2003 | Katogi et al. | 362/219 |

FOREIGN PATENT DOCUMENTS

| | | |
|---|---|---|
| CA | 2282819 | 3/2001 |
| CA | 2282819 A1 * | 3/2001 |
| DE | 297 06 201 U1 | 7/1997 |
| DE | 298 01 699 U1 | 5/1998 |
| WO | WO 00/31463 | 6/2000 |

OTHER PUBLICATIONS

Website located at http://www.sloanLED.com/ printed on Sep. 14, 2001.
Website located at http://www.sloanLED.com/prod02.htm printed on Sep. 14, 2001.
Website located at http://www.permlight.com/products/architectural.html printed on Sep. 14, 2001.

* cited by examiner

*Primary Examiner*—John Anthony Ward
*Assistant Examiner*—Guiyoung Lee
(74) *Attorney, Agent, or Firm*—Fay, Sharpe, Fagan, Minnich & McKee, LLP

(57) ABSTRACT

A border lighting strip (10) includes an electrical cable (14) having a plurality of electrical conductors (14A, 14B). A plurality of light emitting devices (LEDs) (12) arranged alongside the electrical cable (14) and electrically connected (12A, 12B) thereto. An essentially hollow extruded sheath (16) of translucent or transparent material is adapted to receive the LEDs (12). The sheath (16) also includes an integrally formed cylindrical lens (18) arranged to optically cooperate with the LEDs (12). A method (200)for manufacturing a lighting strip includes electrically connecting (202, 204, 206, 208) a plurality of light emitting devices to an electrical cable to form a linear light source (214), extruding (216) a transparent or translucent sheath adapted to receive the linear light source (214), and inserting (218) the linear light source into the extruded sheath to form the border lighting strip (220).

16 Claims, 6 Drawing Sheets

APPARATUS AND MANUFACTURING METHOD FOR BORDER LIGHTING

BACKGROUND OF INVENTION

The invention relates to the lighting arts. It is especially applicable to the illumination of border areas such as the sides of staircases and rooms, and will be described with particular reference thereto. However, the invention will also find application in other areas where a linear lighting apparatus is beneficial, such as in outdoor building border lighting and lighted signs.

Border lighting includes strips of lights or light-emitting material laid along borders of rooms, steps, staircases, and the like. Border lighting enhances safety and increases the brightness of an enclosed space. It can also have aesthetic value. Border lighting is also commonly used outdoors for applications such as safety lighting, lighted signage, and building outlining.

Border lighting strips typically have certain characteristics that differ from general lighting applications. Border lighting is usually not used as primary illumination, and so the luminous intensity requirements are somewhat relaxed. However, border lighting strips are often placed in areas where physical damage to the strip is likely. For example, a border lighting strip along a step of a staircase is likely to be occasionally stepped upon. Outdoor border lighting strips are exposed to the elements. Thus, physical sturdiness is an important quality, and a watertight sealing can also be advantageous.

Another characteristic is that border lighting strips are often used in substantial lengths. For example, installing border lighting along the boundaries of a typical room with dimensions of 18 feet by 15 feet will require approximately 66 feet of strip lighting, neglecting additions or subtractions due to doors, wall protrusions or recesses, and the like. Thus, manufacturing costs become a significant commercial factor, and a low manufacturing cost per unit length is desirable.

Presently, most border lighting is provided by neon border tube systems. However, neon tubes are very fragile, have high power consumption, and are difficult to install. Neon tubes typically require high voltages, thus requiring a specialized power supply, and the high voltages can raise safety concerns. The materials used in neon tubes can present environmental issues.

Border lighting systems that use linear arrays of discrete light emitting devices (LEDs), such as light emitting diodes, are also known. In one prior art border lighting system, the LEDs are physically and electrically mounted to a printed circuit board (PCB) which is surrounded by a light-transmissive housing. The prior art LED-based border lighting systems have several disadvantages, including complex assembly, fragility, and reliability issues arising from the complexity and fragility. Past LED-based border lighting also requires a relatively large number of LEDs per unit length which increases manufacturing and operating costs.

Prior art border lighting using either neon tubes of LED elements affixed to a PCB support is physically rigid and inflexible. These lighting strips cannot be bent around corners in a flexible manner.

The present invention contemplates an improved border lighting strip that overcomes the above-mentioned limitations and others.

SUMMARY OF INVENTION

In accordance with one embodiment of the present invention, a border lighting strip is disclosed. An electrical cable includes a plurality of electrical conductors. A plurality of light emitting devices (LEDs) are arranged alongside the electrical cable and electrically connected thereto. A sheath at least partially made from a light transmissive material has a hollow region adapted to receive the LEDs. The sheath has an integrally formed cylindrical lens arranged to optically cooperate with the LEDs.

In accordance with another embodiment of the present invention, a linear lamp is disclosed. An essentially hollow tube of translucent or transparent material has a plurality of light emitting elements arranged within. At least one electrical wire is arranged within the tube for supplying electrical power to the light emitting elements.

In accordance with yet another embodiment of the present invention, a lighting strip is disclosed. A cord includes a plurality of parallel conductive wires and an insulating coating. A plurality of light emitting elements are affixed to the cord and arranged to receive electrical power therefrom. An at least partially light transmissive tube surrounds the plurality of light emitting elements and at least a portion of the cord.

In accordance with still yet another embodiment of the present invention, a method is disclosed for manufacturing a lighting strip. A plurality of light emitting devices are electrically connected to an electrical cable to form a linear light source. A transparent or translucent sheath is extruded. The sheath is adapted to receive the linear light source. The linear light source is inserted into the extruded sheath.

One advantage of the present invention is that it provides a rugged and durable border lighting, which can also be made water-tight.

Another advantage of the present invention is that it is manufactured in a simple and cost-effective manner.

Another advantage of the present invention is that it provides physically flexible border lighting.

Yet another advantage of the present invention is that the light is spread using an optical component built into the protective tube housing to minimize the number of light emitting elements required per unit length.

Numerous additional advantages and benefits of the present invention will become apparent to those of ordinary skill in the art upon reading and understanding the following detailed description.

BRIEF DESCRIPTION OF DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION

Figure 1:
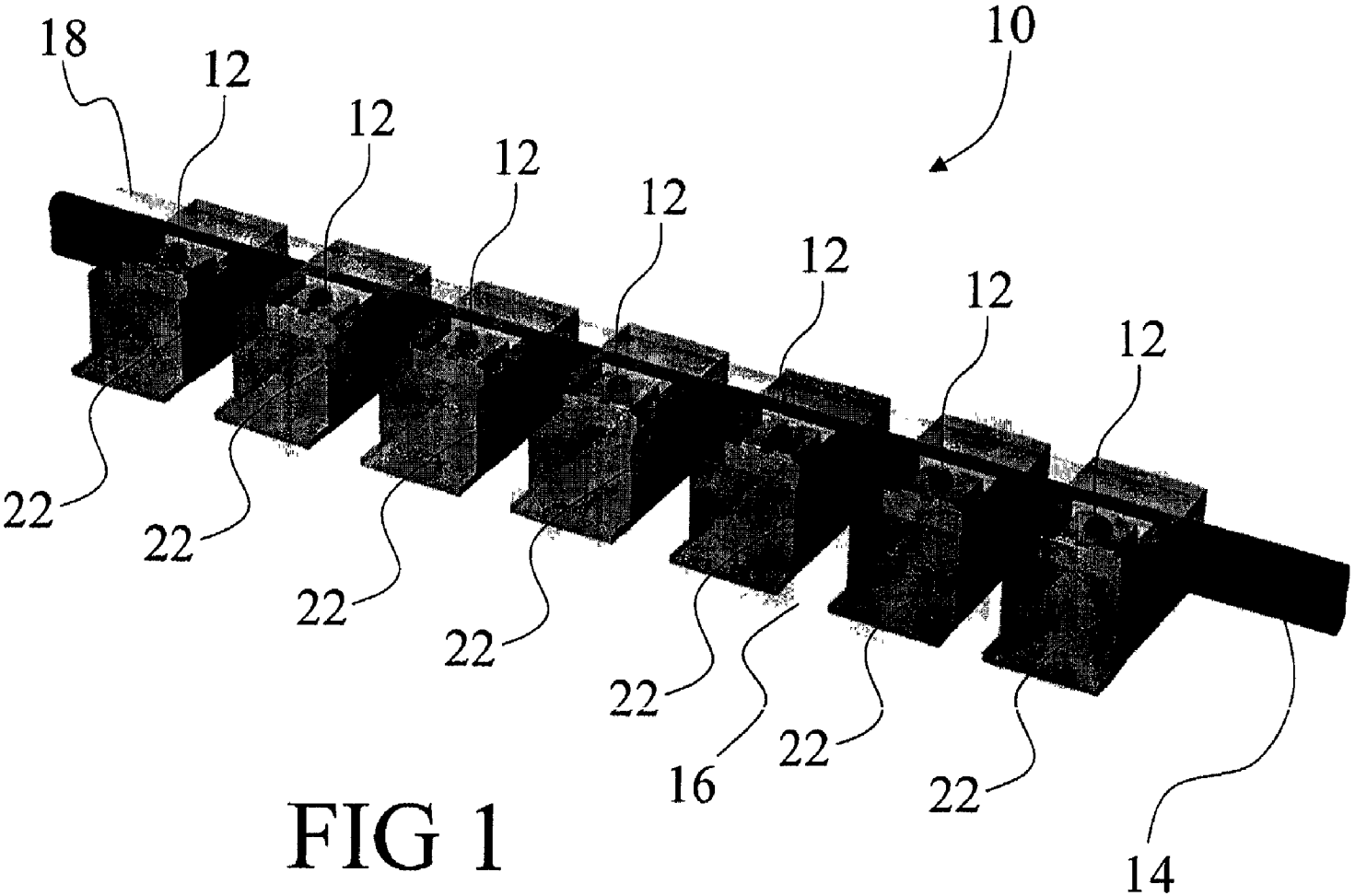
FIG. 1 shows a perspective view of a length of border lighting that suitably practices an embodiment of the invention.

With reference to FIGS. 1, 2, 3, and 4, a length of an exemplary border lighting tube or lamp 10 is described. The light source 10 includes a plurality of light emitting elements 12 arranged alongside an electrical cable or cord 14. The cable 14 includes a plurality of electrically insulated wires, represented in FIG. 2 by two thickened regions 14A, 14B corresponding to two wires. The exemplary light emitting elements 12 are light emitting diodes such as phosphide-based red light emitting diodes, blue or blue/green nitride-based light emitting diodes, phosphor-coated UV light emitting diodes emitting white or other colored light, or the like. Mixtures of light emitting diodes of various types on the cable 14 are also contemplated, as are other light emitting elements such as miniature incandescent lamps.

Figure 2:
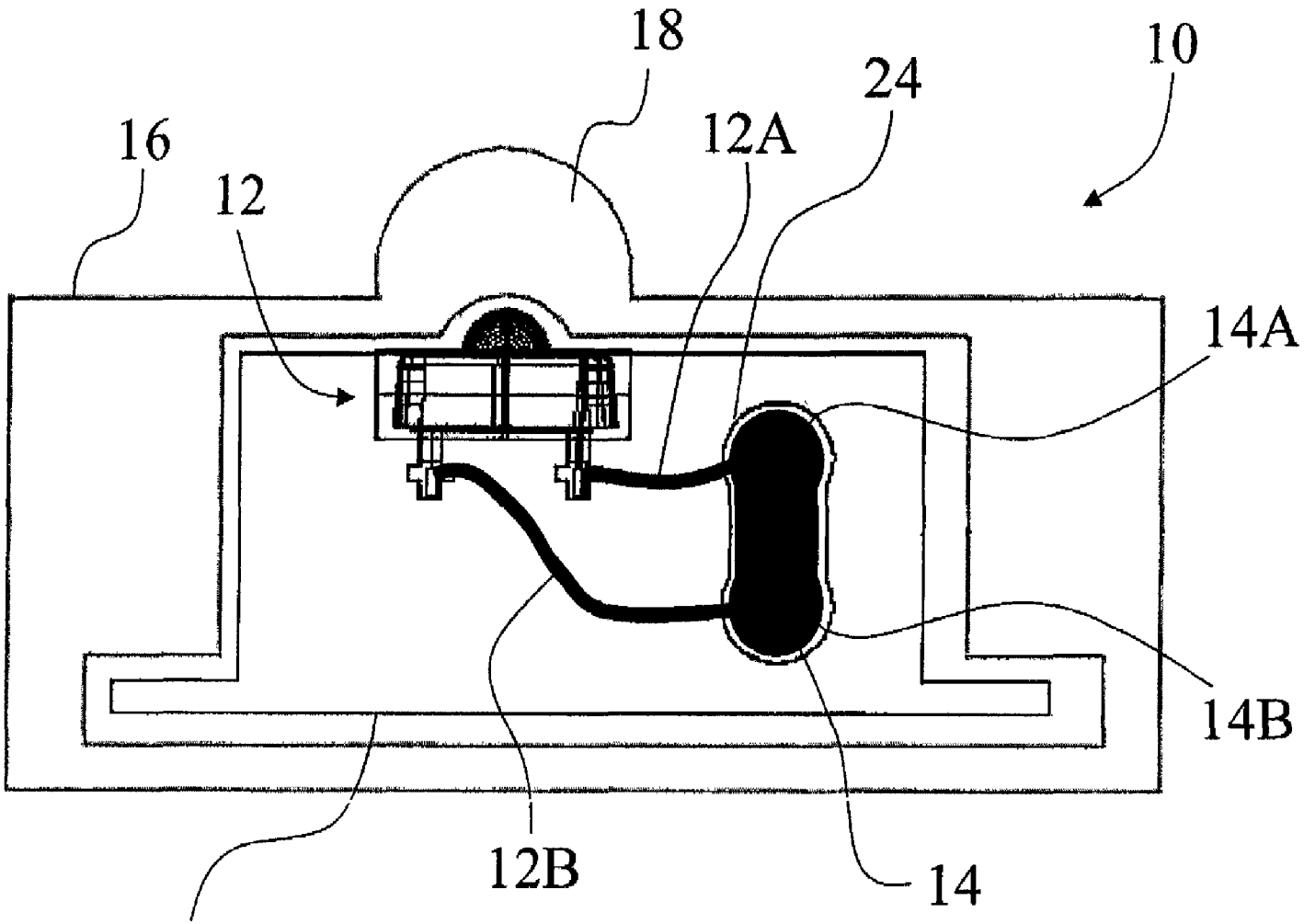
FIG. 2 shows a cross-sectional view of the embodiment of FIG. 1.

Each of the light emitting elements 12 preferably includes a lead frame having leads 12A, 12B for electrical connection to the light emitting element 12. The formation of the light emitting element 12, e.g. light emitting diode, and its connection to leads 12A, 12B of a lead frame can be performed in a large number of ways which are well known to those skilled in the art. The light emitting elements 12 are electrically powered by the cable 14 through leads 12A, 12B (FIG. 2). The leads 12A, 12b are connected to the cable wires 14A, 14B, for example by crimping or soldering. Crimped connections are simple to implement and are advantageously rugged compared with many types of soldering bonds.

The tube lighting 10 also includes an at least partially light transmissive housing, tube, or sheath 16 which is essentially hollow and surroundingly receives the light emitting elements 12 and at least a portion of the electrical cable 14. The sheath 16 shields the light emitting elements 12 and the covered portion of the cable 14 from external influences, and is optionally watertight. However, the sheath 16 is at least partially light transmissive at least for light generated by the light emitting elements 12.

The light emitting elements 12 are advantageously supported inside the sheath 16 by a support, socket, or mount 22. In the exemplary embodiment of FIGS. 1 through 4 there is a separate mount 22 corresponding to each light emitting element 12. However, a mount that supports a plurality of light emitting elements is also contemplated. The exemplary mount 22 has an opening 24 through which the cable 14 passes. However, the mount 22 could also be connected to the cable 14 in other ways, such as by clamping or by the use of an adhesive.

Figure 3:
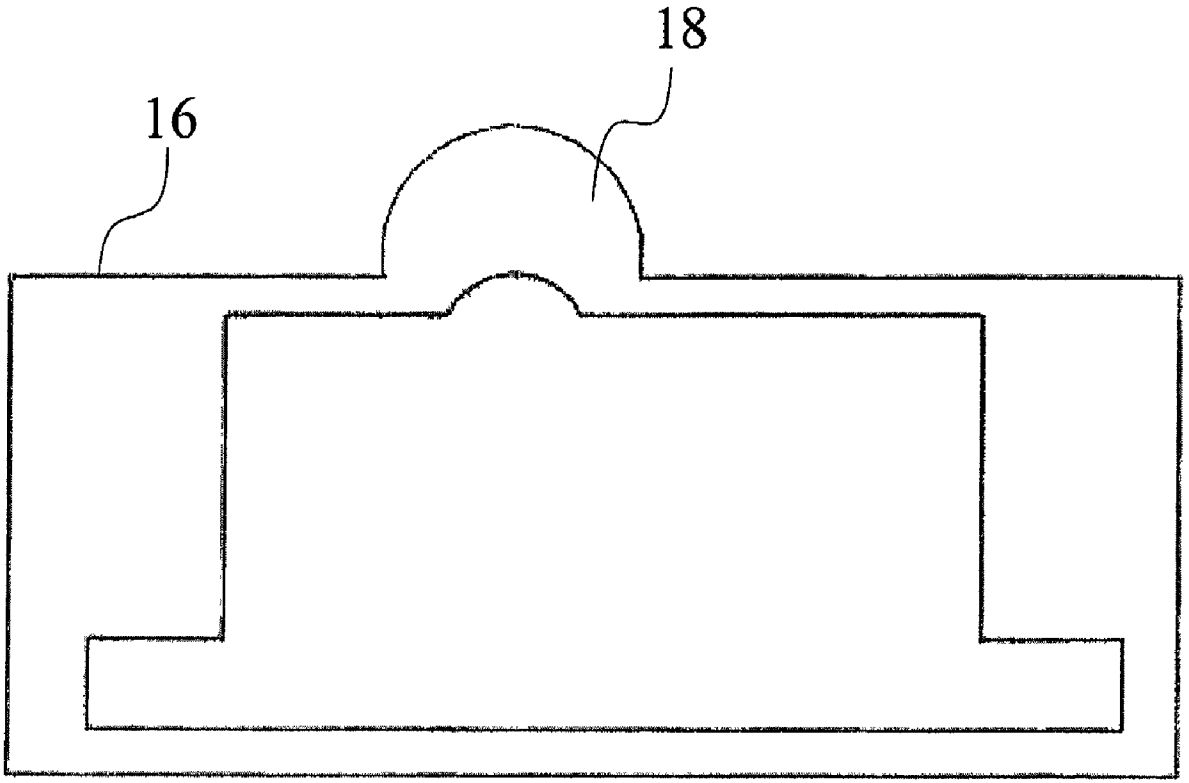
FIG. 3 shows a cross-sectional view of the light transmissive extruded sheath of the embodiment of FIG. 1.
Figure 4:
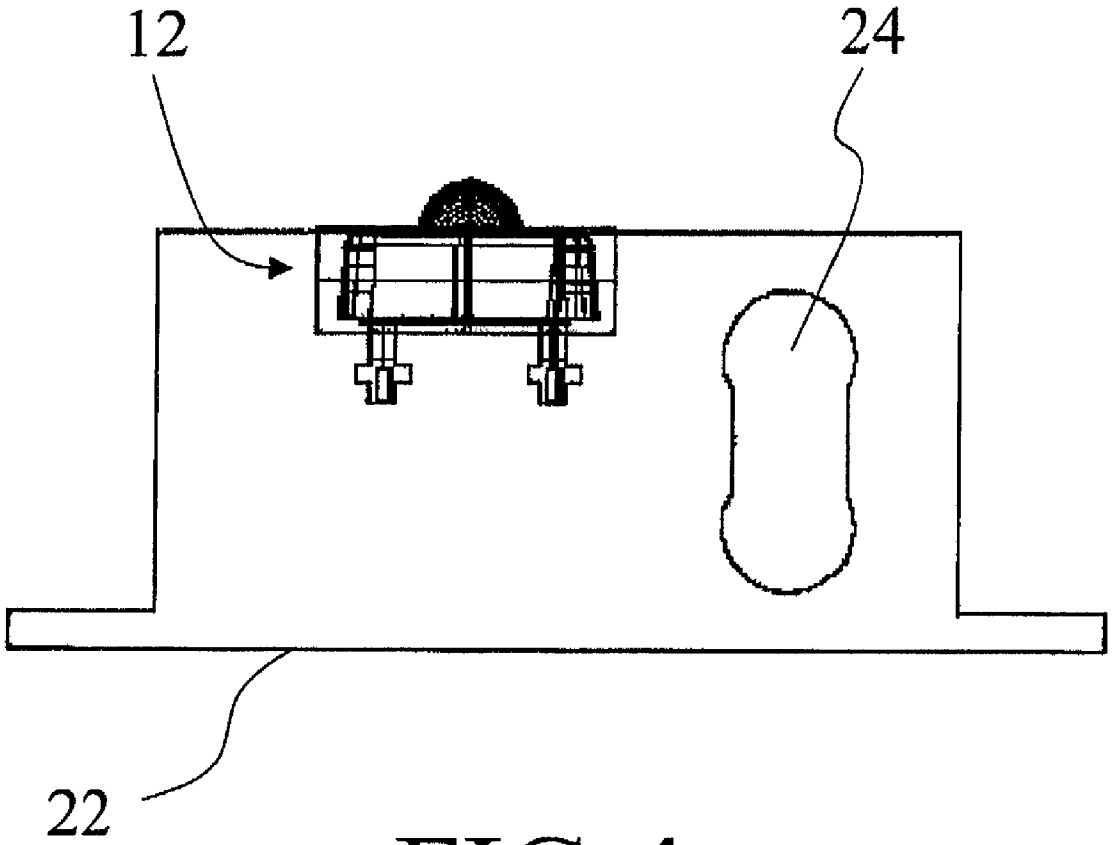
FIG. 4 shows a cross-sectional view of one of the plurality of light emitting elements of the embodiment of FIG. 1 along with its mount.

As best seen in FIGS. 2 and 3, the housing, sheath, or tube 16 includes an integral optical element 18, which in the illustrated embodiment is a cylindrical lens 18, that optically cooperates with the light emitting elements 12 to distribute the emitted light using one or more selected operative modes. In one operative mode, the integral optical element 18 provides wave guiding that distributes the light along the tube. In another operative mode, the optical element 18 includes one or more refracting portions that refract light generated by the light emitting elements in a manner which enhances distribution of light perpendicular to the tube 16. It is also contemplated that the single cylindrical lens 18 provide both wave guiding and perpendicular refracting.

Those skilled in the art will recognize that forming the sheath 16 using a material having a high refractive index enhances the effectiveness of both the refracting and the wave guiding operative modes. Furthermore, the optical behavior is optionally not limited to a particular optical element 18 of the sheath 16. Rather, the entire sheath 16 or significant portions thereof beyond the optical element 18 optionally cooperate with the light emitting elements 12 to achieve a desired light distribution. Through the refractive and/or wave guiding activity of the optical element 18 with optional involvement of the sheath 16, the border tube 10 can be thickened more than would be otherwise cosmetically acceptable, and the number of light emitting elements 12 per unit length can be reduced.

In the embodiment illustrated in FIGS. 1 through 4, the light emitting elements 12 are arranged in a straight line facing a single direction. However, embodiments where the light emitting elements are arranged in a curved, spiral or other pattern are also contemplated. Furthermore, the sheath or tube 16 can be made from either a rigid or a flexible transparent or translucent material. A flexible sheath 16 results in a flexible linear border lighting 10 which can be arranged to follow corners and other turns within turning radius limits imposed by the sheath 16 or the cable 14. However, a rigid sheath 16 may be preferred for horizontal wall mounting and other applications.

Figure 5:
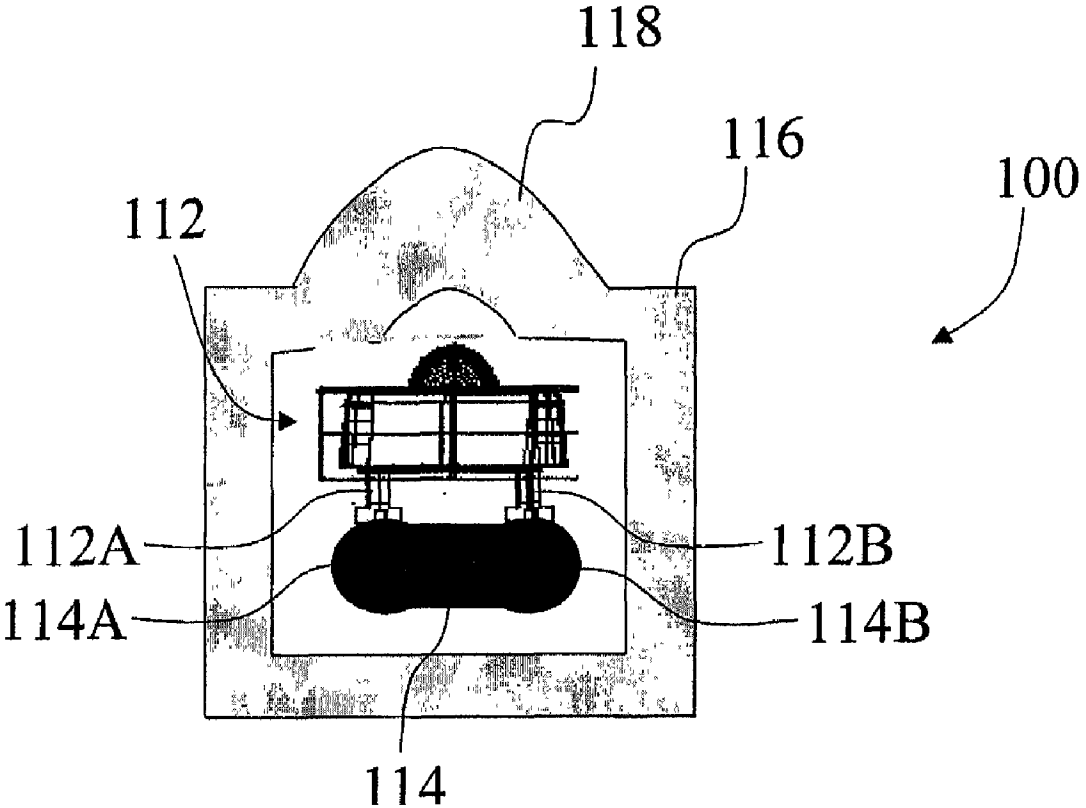
FIG. 5 shows a cross-sectional view of another border lighting that suitably practices an embodiment of the invention.

With reference to FIG. 5, a strip light 100 that suitably practices another embodiment of the invention is shown in cross-section. The light source 100 includes a plurality of light emitting elements 112 arranged alongside an electrical cable 114. The cable 114 includes a plurality of electrically insulated wires, represented in FIG. 5 by two thickened regions 114A, 114B corresponding to two wires. The exemplary light emitting elements 112 are light emitting diodes such as phosphide-based red light emitting diodes, blue or blue/green nitride-based light emitting diodes, phosphor-coated UV light emitting diodes emitting white or other colored light, or the like. Mixtures of light emitting diodes of various types on the cable 114 are also contemplated, as are other light emitting elements such as miniature incandescent lamps.

Each of the light emitting elements 112 preferably includes a lead frame having leads 112A, 112B for electrical connection to the light emitting element 112. The formation of the light emitting element 112, e.g. light emitting diode, and its connection to leads 112A, 12B of a lead frame can be performed in a large number of ways which are well known to those skilled in the art. The light emitting elements 112 are electrically powered by the cable 114 directly through contacts 112A, 112B, for example by crimping or soldering. Crimped connections are advantageously rugged compared with many types of soldering bonds. The tube lighting 100 also includes a translucent or transparent sheath 116 which is essentially hollow and surroundingly receives the light emitting elements 112 and at least a portion of the electrical cable 114. The sheath 116 shields the light emitting elements 112 and the covered portion of the cable 114 from external influences, and is optionally watertight. However, the sheath 116 is substantially light transmissive at least for light generated by the light emitting elements 112.

In the embodiment of FIG. 5, the transparent or translucent housing, sheath, or tube 116 includes an integral optical element 118, which in the illustrated embodiment is a cylindrical lens 118, that optically cooperates with the light emitting elements 112 to distribute the emitted light using one or more selected operative modes. In one operative mode, the integral optical element 118 provides wave guiding that distributes the light along the tube. In another operative mode, the optical element 118 includes one or more refracting portions that refract light generated by the light emitting elements in a manner which enhance distribution of light perpendicular to the tube 116. It is also contemplated that the single cylindrical lens 118 provide both wave guiding and perpendicular refracting.

Those skilled in the art will recognize that forming the sheath 116 using a material having a high refractive index enhances the effectiveness of both the refracting and the wave guiding operative modes. Furthermore, the optical behavior is optionally not limited to a particular optical element 118 of the sheath 116. Rather, the entire sheath 116 or significant portions thereof beyond the optical element 118 optionally cooperate with the light emitting elements 112 to achieve a desired light distribution. Through the refractive and/or wave guiding activity of the optical element 118 with optional involvement of the sheath 116, the border tube 100 can be thickened more than would be otherwise cosmetically acceptable, and the number of light emitting elements 112 per unit length can be reduced.

In the embodiment illustrated in FIG. 5, the light emitting elements 112 are arranged in a straight line facing a single direction. However, embodiments where the light emitting elements are arranged in a curved, spiral or other pattern are also contemplated (not shown). Furthermore, the sheath or tube 116 can be made from either a rigid or a flexible transparent or translucent material. A flexible sheath 116 results in a flexible linear border lighting 100 which can be arranged to follow corners and other turns within turning radius limits imposed by the sheath 116 or the cable 114. However, a rigid sheath 116 may be preferred for horizontal wall mounting and other applications.

Figure 6:
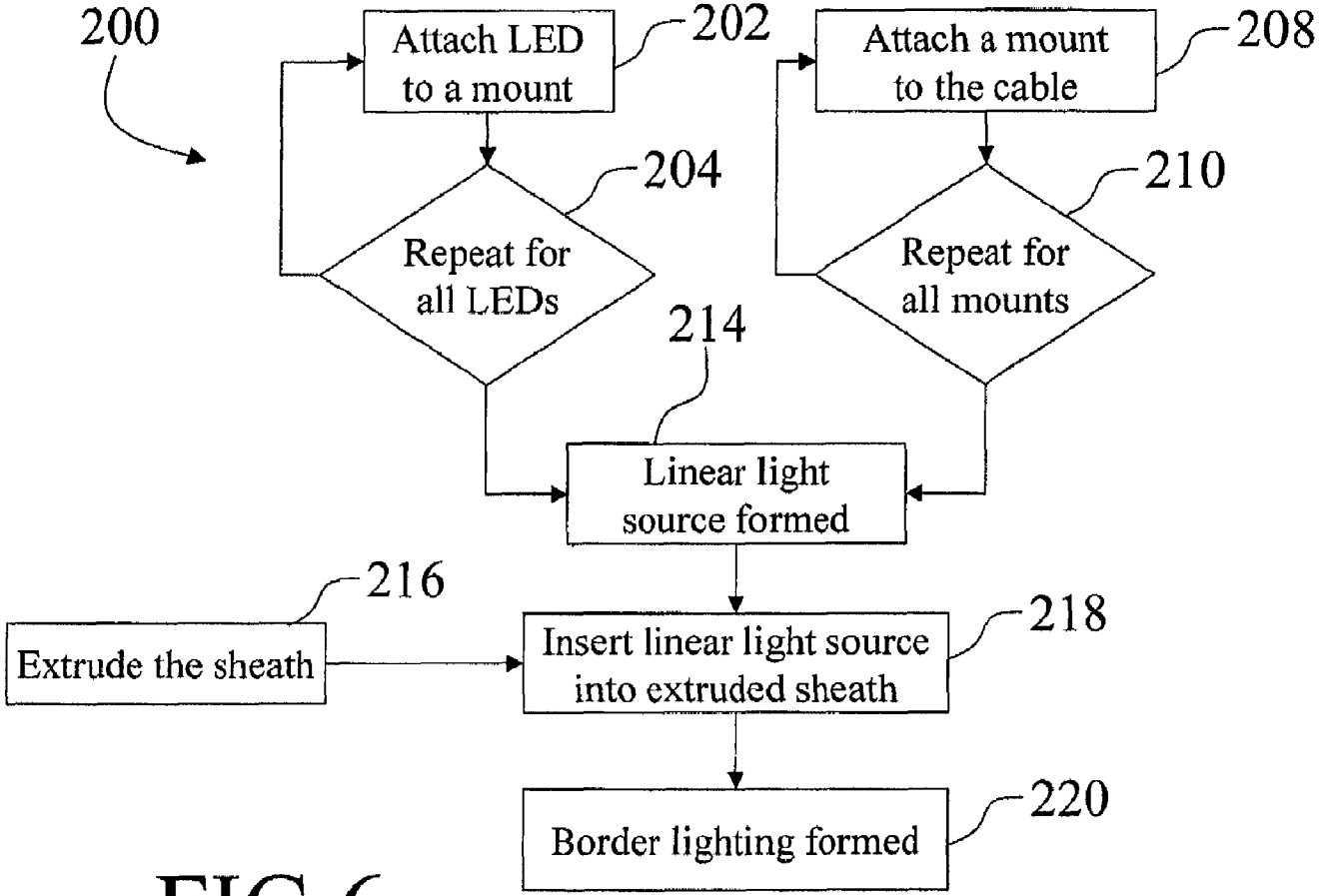
FIG. 6 schematically shows an exemplary strip light manufacturing process that suitably practices an embodiment of the invention.

With reference to FIG. 6, an exemplary manufacturing process 200 for manufacturing a border lighting strip such as the exemplary border lighting strip 10, 100 is described. In the case where the light emitting devices (LEDs) include a mount, e.g. the mount 22 of FIGS. 1, 2, and 4, an LED is attached 202 to a mount. The attaching 202 is repeated 204 for all the LEDs. The attaching 202 is advantageously both physical and electrical, with the latter accomplished by soldering, wire bonding, or the like.

A mount is attached 208 to the cable by crimping, soldering, or the like, and the attaching 208 is repeated 210 for all the mounts. It will be appreciated that the order of the attachings 202, 208 is unimportant, i.e. the LEDs can be attached 202 to the mounts followed by attaching 208 of the mounts to the cable, or alternatively the mounts can be attached 208 to the cable and the LEDs attached 202 to the mounts. In most manufacturing situations, however, it will be preferred to attach 202 the LEDs to the mounts first. For manufacturing of the border lighting embodiment of FIG. 5 wherein no mount is employed, the LEDs are directly attached to the cable using crimping, soldering, or the like, without the intercession of a mount. The electrical connecting 202, 204, 208, 210 of the LEDs to the cable forms a linear light source 214.

The sheath, e.g., the sheath 116 of FIGS. 1 through 3 or the sheath 116 of FIG. 5, can be formed by any suitable manufacturing process. A preferred method for the sheath formation is extrusion molding 216. Extrusion has a number of manufacturing advantages, including: providing a high degree of freedom in selecting the cross-sectional shape; providing the ability to form a wide range of materials including both flexible and rigid formed materials; and the providing the ability to generate an essentially infinitely variable extruded tube length. The linear light source 214 is inserted 216 into the extruded 216 sheath to form the border lighting 220.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A linear lamp comprising:

an essentially hollow tube of translucent or transparent material including an extended cylindrical lens having a length substantially coextensive with a length of the hollow tube, wherein the tube and the lens are integrally formed by a single extrusion;

a plurality of light emitting elements arranged within the tube and optically coupled with the extended cylindrical lens; and at least one electrical wire arranged within the tube for supplying electrical power to the light emitting elements.

2. The linear lamp as set forth in claim 1, wherein the extended cylindrical lens defines a wave guide portion that distributes light generated by the light emitting elements along the tube.

3. The linear lamp as set forth in claim 1, wherein the extended cylindrical lens refracts light generated by the light emitting elements in a plane perpendicular to the tube.

4. The linear lamp as set forth in claim 1, further including:

a plurality of conductors that electrically and mechanically connect the light emitting elements to the at least one electrical wire.

5. The linear lamp as set forth in claim 1, wherein:

the tube is flexible whereby the linear lamp is flexible and arrangeable in a non-straight orientation.

6. A method for manufacturing a lighting strip, the method comprising:

electrically connecting a plurality of light emitting devices to an electrical cable to form a linear light source;

extruding a transparent or translucent sheath including an integral optical element, the sheath adapted to receive the linear light source;

simultaneously with the extruding of the sheath, extruding a cylindrical lens parallel to and integrally formed with the sheath; and inserting the linear light source into the extruded sheath with the linear light source arranged to be in optical communication with the optical element.

7. The method as set forth in claim 6, wherein electrically connecting includes:

attaching a mount to the electrical cable, which attaching includes an electrical connection between the mount and the cable; and physically and electrically bonding one of the light emitting devices to the mount.

8. The method as set forth in claim 6, wherein electrically connecting includes:

crimping electrical leads of one of the light emitting devices to the electrical cable to establish an electrical connection therebetween; and repeating the crimping for each of the plurality of light emitting devices.

9. A border lighting strip comprising:

an electrical cable including at least two electrical conductors;

a mount attached to the electrical cable;

a light emitting device (LED) mounted to the mount and electrically connected to the electrical conductors; and a sheath at least partially made from a light transmissive material, the sheath having a hollow region adapted to receive the electrical cable, the mount and the LED, and an integrally formed cylindrical lens arranged to optically cooperate with the LED, wherein the mount has a complementary shape to the hollow region of the sheath so that the LED is arranged to face the cylindrical lens and is inhibited from moving around an axis parallel to the cylindrical lens.

10. The border lighting strip as set forth in claim 9, wherein the sheath includes:

an extruded length of light transmissive material of high refractive index.

11. The border lighting strip as set forth in claim 9, wherein the sheath includes:

an extruded length of a wave guiding material for distributing light along the length of the sheath.

12. The border lighting strip as set forth in claim 9, wherein each LED has associated therewith a lead frame which provides for electrical connection of the LED to the cable.

13. The border lighting strip as set forth in claim 9, wherein:

the light emitting devices (LEDs) include light emitting diodes.

14. The border lighting strip as set forth in claim 13, wherein the light emitting diodes are selected from a group consisting of:

phosphide-based red light emitting diodes, blue or blue/green nitride-based light emitting diodes, and phosphor-coated UV light emitting diodes emitting white or other colored light.

15. The lighting strip of claim 9, wherein the hollow region of the sheath defines first channel and the mount includes a first tab that fits into the first channel so that the mount is inhibited from rotating in the axis parallel to the cylindrical lens.

16. The lighting strip of claim 15, wherein the hollow region of the sheath defines a second channel that is opposite the first channel and the mount includes a second tab that is opposite the first tab, the second tab fits into the second channel so that the mount is inhibited from rotating in the axis parallel to the cylindrical lens.

* * * * *